US007147010B2

(12) United States Patent
Froment et al.

(10) Patent No.: US 7,147,010 B2
(45) Date of Patent: Dec. 12, 2006

(54) HEDDLE FRAME AND WEAVING LOOM PROVIDED WITH AT LEAST ONE SUCH FRAME

(75) Inventors: Jean-Paul Froment, Doussard (FR); Patrick Iltis, Saint Jorioz (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 10/892,501

(22) Filed: Jul. 16, 2004

(65) Prior Publication Data

US 2005/0011577 A1 Jan. 20, 2005

(30) Foreign Application Priority Data

Jul. 18, 2003 (FR) ..... 03 08818
Jul. 18, 2003 (FR) ..... 03 08819

(51) Int. Cl.
*D03C 9/06* (2006.01)

(52) U.S. Cl. ..... 139/91; 139/92

(58) Field of Classification Search ..... 139/52–53, 139/91–93

See application file for complete search history.

(56) References Cited

U.S. PATENT DOCUMENTS 3,071,164 A * 1/1963 Nussbaum ..... 139/92
3,895,655 A 7/1975 Sujdak et al.
4,106,529 A 8/1978 Kaufmann
4,106,530 A * 8/1978 Kaufmann ..... 139/92
4,508,145 A 4/1985 Bowen et al.
4,643,232 A * 2/1987 Wagner ..... 139/92
4,913,193 A * 4/1990 Faasse ..... 139/91
5,232,025 A * 8/1993 Gysin et al. ..... 139/92
5,280,810 A * 1/1994 Shimizu ..... 139/91
6,009,918 A * 1/2000 Beyaert ..... 139/92
6,131,619 A * 10/2000 Faasse et al. ..... 139/92

FOREIGN PATENT DOCUMENTS

| | | |
|---|---|---|
| DE | 918020 | 9/1954 |
| EP | 0302798 A2 | 2/1989 |
| EP | 0457210 A1 | 11/1991 |
| EP | 1170409 A1 | 1/2002 |
| FR | 2312923 | 12/1976 |
| WO | WO 97/26396 | 7/1997 |

OTHER PUBLICATIONS

Steel vs. Aluminum: The Basic Facts (http://ussautomotive.com/auto/steelvsal/basicfacts.htm), Sep. 28, 2002.*

* cited by examiner

*Primary Examiner*—Gary Welch
*Assistant Examiner*—Andrew W. Sutton
(74) *Attorney, Agent, or Firm*—Dowell & Dowell, PC

(57) ABSTRACT

A heddle frame comprises two uprights and two crossbeams, each of which is provided with a catching member adapted to receive a corresponding end of at least one heddle, while there are also provided damping means, mounted to at least one corresponding catching member, which are placed opposite surfaces for direct abutment of the catching member against the at least one heddle. The catching member is formed by at least one bent metal sheet retains the damping means by cooperation of their complimentary shapes and/or by adhesion.

26 Claims, 4 Drawing Sheets

HEDDLE FRAME AND WEAVING LOOM PROVIDED WITH AT LEAST ONE SUCH FRAME

BACKGROUND OF THE INVENTION

The present invention relates to a heddle frame, as well as to a weaving loom equipped with at least one such frame.

BRIEF DESCRIPTION OF THE RELATED ART

It is known to equip a weaving loom with heddle frames which arc intended to be controlled in a movement of vertical oscillations thanks to an appropriate device, such as a weaving system or a dobby.

Such a heddle frame firstly comprises a body, which is formed by reversibly assembling two uprights and two crossbeams. In service, the uprights are substantially vertical, while the crossbeams are substantially horizontal. Each crossbeam also supports a catching member, also called a bar, which allows the fixation of a corresponding end of the heddles of the weaving loom.

The invention aims more particularly at such a heddle frame which is provided with damping means, interposed between the catching member and the heddles, at at least one end of the latter. In this way, during the oscillations of the frame, certain direct contacts between the catching member and the heddles are eliminated, this reducing the vibrations by the heddles rebounding on the bars and, consequently, the overall wear undergone by these different mechanical elements, while increasing the duration of use.

U.S. Pat. No. 3,895,655 describes a heddle frame, which is provided with such vibration damping elements. These resilient elements, which are fixed on each crossbeam, are interposed between the opposite faces of these crossbeams and the heddles, so as to act on the ends of the latter.

However, this known solution presents has certain drawbacks, in that it is difficult to master control the distance separating these damping elements and the catching member. Furthermore, the operation of fixing these resilient elements proves to be costly, while their presence create a considerable additional mass on the whole of the frame.

It is also known, by U.S. Pat. No. 4,106,529 and U.S. Pat. No. 4,106,530, to insert resilient damping elements between the heddles and the catching members. These damping elements, which are provided on one side or both sides of the catching members, may be disposed freely, or be fixed in grooves made on the catching members.

However, this alternative solution involves other drawbacks.

In effect, if the damping elements are mounted freely, their positioning proves to be unsatisfactory. On the other hand, if they are received in grooves, it is difficult and expensive to produce the catching member, since the aforementioned grooves have very small dimensions and are delicate to machine. Furthermore, such a solution contributes to rendering the whole of the catching member particularly heavy.

This being specified, it is an object of the invention to produce a heddle frame enabling the various drawbacks of the prior art set forth hereinabove to be overcome.

In particular, it proposes to produce such a frame which, while being provided with damping means positioned precisely, conserves an acceptable mass and reduced manufacturing costs.

SUMMARY OF THE INVENTION

To that end, the invention relates to a heddle frame for a weaving loom, said frame comprising two uprights and two crossbeams, each crossbeam being provided with a catching member adapted to receive a corresponding end of at least one heddle of said frame, while there are also provided damping means, fast with at least one corresponding catching member, this at least one catching member being formed by at least one bent metal sheet.

The invention also relates to a weaving loom equipped with at least one heddle frame as defined hereinabove.

BRIEF DESCRIPTION OF THE DRAWINGS

The invention will be more readily understood on reading the following description of a weaving loom and of a plurality of heddle frames in accordance with its principle, given solely by way of non-limiting examples and made with reference to the accompanying drawings, in which.

DESCRIPTION OF PREFERRED EMBODIMENTS

Figure 1:
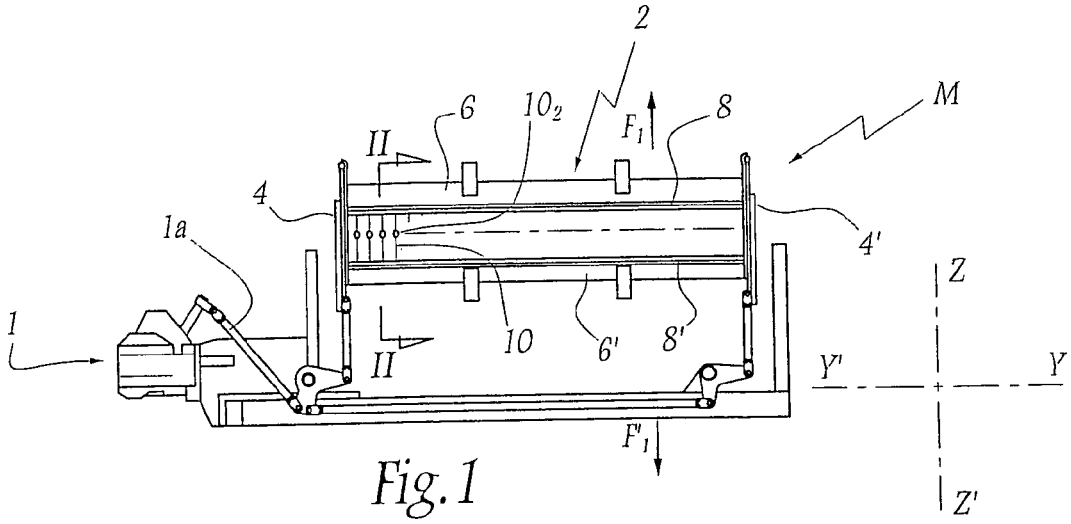
FIG. 1 schematically shows a weaving loom according to the invention.

Referring now to the drawings, FIG. 1 shows a dobby 1, of type known per se, which is intended to drive a heddle frame 2 belonging to a weaving loom M, in a vertical oscillating movement materialized by arrows $F_1$ and $F'_2$. To that end, an actuating arm 1*a* of the dobby is coupled to each heddle frame 2, by means of connecting rods and rocking levers. The loom M comprises a plurality of frames, generally between six and twenty four, of which only one is shown in FIG. 1 in order to render the drawing clearer.

Each frame 2 comprises a body, which is formed by the assembly of two uprights 4, 4' and of two crossbeams 6, 6'. Uprights 4, 4' extend substantially in a direction parallel to that, Z–Z', of vertical oscillation of the frames, namely vertically in service. Furthermore, crossbeams 6, 6' extend in a direction Y–Y', which is perpendicular to that, Z–Z', mentioned above, namely horizontally in service.

Each upper (6) and lower (6') crossbeam is respectively equipped, in known manner, with a corresponding catching member, or bar 8, 8'. These bars 8 and 8', which will be described in greater detail in the following, allow the fixation of the respectively upper and lower ends of different heddles 10, belonging to the frame 2 of the weaving loom M.

Figure 2:
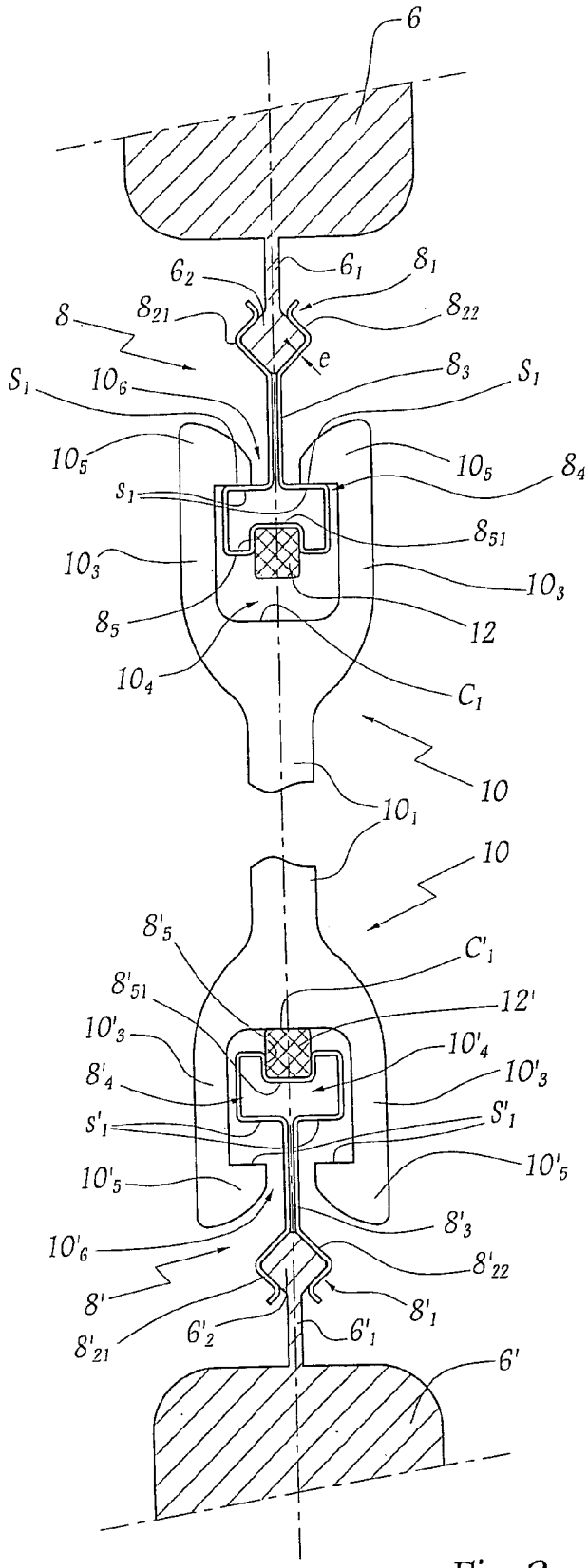
FIG. 2 is a view in transverse section, along line II—II in FIG. 1, partially illustrating a heddle frame belonging to the weaving loom of FIG. 1, in particular concerning the mutual connection of a crossbeam, a catching member and a heddle belonging to this frame.

FIG. 2 illustrates the fixation of the upper end of a heddle 10 on the upper crossbeam 6, by means of the bar 8. It should be noted that the fixation of the lower end of this heddle 10 on the crossbeam 6' is effected in similar manner, by means of the bar 8'. In this spirit, the mechanical elements of the lower crossbeam 6', of the lower bar 8' and of the lower end of the heddle 10, similar respectively to those of the upper crossbeam 6, the upper bar 8 and the upper end of the heddle 10, bear the same numerals to which the reference "prime" has been added.

The structure of the upper crossbeam 6, which is conventional, will not be described in greater detail in the following. The lower face of this crossbeam 6, facing towards the heddle 10, is extended by a rib $\mathbf{6}_1$ extending over the whole principal dimension of this crossbeam. This rib $\mathbf{6}_1$ is extended by a lug $\mathbf{6}_2$ presenting, in cross section, substantially the shape of a rhombus.

The catching bar 8 is formed by a bent thin metal sheet whose thickness e is less than 1.5 mm and preferably less than 1.0 mm such as for example close to 0.7 mm. It firstly comprises a region $\mathbf{8}_1$, allowing the fixation of the bar 8 on the crossbeam 6, by cooperation of shapes.

More precisely, this region of fixation is formed by two branches $\mathbf{8}_{21}$ and $\mathbf{8}_{22}$, substantially in the form of an L, of which the angles are located opposite each other, so as to cover the afore-mentioned lug $\mathbf{6}_2$. It should also be noted that these branches $\mathbf{8}_{21}$, $\mathbf{8}_{22}$ constitute the free ends of the bent metal sheet, forming the catching bar 8.

The existence of this lug $\mathbf{6}_2$, associated with the branches $\mathbf{8}_{21}$ and $\mathbf{8}_{22}$, thus provides the possibility for the crossbeam 6 to be removably attached to the bar 8.

In this respect, it will be noted that the bent sheet constituting the bar 8 is advantageously elastic and/or pre-stressed.

The two branches $\mathbf{8}_{21}$ and $\mathbf{8}_{22}$ join, opposite the crossbeam 6, in an intermediate region $\mathbf{8}_3$, of reduced cross section. Finally, the latter region extends in a region $\mathbf{8}_4$ intended for catching the heddle 10, which will be described in greater detail hereinbelow.

This heddle 10 conventionally comprises a wire-like element $\mathbf{10}_1$, provided with an eye $\mathbf{10}_2$, visible in FIG. 1, intended for the passage of the warp yarn (not shown). At each end of the heddle, the wire-like element $\mathbf{10}_1$ extends in two principal branches $\mathbf{10}_3$, defining a housing $\mathbf{10}_4$ for receiving the bar 8. The opening of this housing is bordered by two teeth $\mathbf{10}_5$ of the heddle, extending towards each other, so as to form a neck $\mathbf{10}_6$ of reduced transverse dimensions.

Returning to the catching region $\mathbf{8}_4$, the latter presents an approximately rectangular cross section, of which the dimensions are clearly greater than those of the intermediate region $\mathbf{8}_3$. This catching region $\mathbf{8}_4$ forms, in its lower part opposite the crossbeam 6, a U-shaped bend $\mathbf{8}_5$ whose web $\mathbf{8}_{51}$ faces towards the crossbeam 6.

This bend ensures retention of a damping element 12, of type known per se, which is a supple element, made for example of a polymer material, an elastomer material, or the like. Such a damping element, which extends over substantially the whole of the principal dimension of the crossbeam 6, is retained by wedging and/or adhesion in the interior volume of the U-shaped bend $\mathbf{8}_5$.

In configuration of use of the weaving loom M, the intermediate region $\mathbf{8}_3$ is received in the neck $\mathbf{10}_6$, while the catching region $\mathbf{8}_4$ is received in the housing $\mathbf{10}_4$. The same applies to the lower end of the crossbeam, the different mechanical elements being arranged symmetrically with respect to the median horizontal axis of the frame 2.

More precisely, $s_1$ denotes the surfaces of the upper catching bar 8, which are adapted to come into direct abutment against the opposite surfaces $S_1$ of the heddle, belonging to the two teeth $\mathbf{10}_5$. These direct abutment surfaces $s_1$ and $S_1$ form a zone of traction, opposite the zone of compression, corresponding to the free surfaces of the damping element 12 and to the opposite ones, $C_1$, of the heddle 10.

In the static state, as illustrated in FIG. 1, when the upper end of the heddle is in direct abutment against the opposite upper surfaces $s_1$ of the bar 8, the lower end of this heddle is substantially in abutment against the lower damping element 12', at its lower compression surfaces $C'_1$. Of course, when the lower end of the heddle is in direct abutment, by its traction surfaces $S'_1$. on the surfaces $S'_1$ of the lower bar 8', the upper part of this heddle is substantially in abutment, by its upper compression surfaces $C_1$, against the upper damping element 12.

Such a measure is advantageous. In effect, the respectively upper (6) and lower (6') crossbeams are subjected in service to vibrations, this rendering their spaced apart relationship variable. The heddles come into contact, respectively with the bar and with the damping element, sometimes by their traction surfaces and sometimes by their compression surfaces, the shocks on the compression surfaces contributing to damping the vibrations.

The fact of providing a substantially simultaneous abutment on the lower or upper traction surfaces and on the upper or lower compression surfaces, makes it possible for the crossbeams 6 and 6' to work in a configuration where the heddles are substantially rectilinear. This is favorable to the transmission of a maximum effort of compression. One of the two crossbeams, which ensures a role of damper, therefore absorbs a considerable effort and makes it possible to reduce the flexion of the other crossbeam, in that case ensuring an effort of traction.

In this way, during the oscillations of the frame 2, the presence of the respectively upper (12) and lower (12') damping elements makes it possible to reduce the axial oscillations/vibrations of the heddles and their shocks on the bars. This therefore ensures a reduction of the overall wear undergone by these heddles and these bars, and consequently an increase in the duration of use thereof.

In FIG. 2, damping means 12 and 12' are mounted to the respectively upper (8) and lower (8') bars. However, it may be provided to equip only one of these bars, 8 or 8', with such damping means, while the other, 8' or 8, is bereft thereof. In that case, when the single damping means 12 or 12', secured to the bar 8 or 8', are in contact with the compression surfaces of the opposite end of the heddle, the other end thereof is advantageously in contact, by its traction surfaces $S'_1$ or $S_1$, with the other opposite catching bar 8' or 8.

Figure 3:
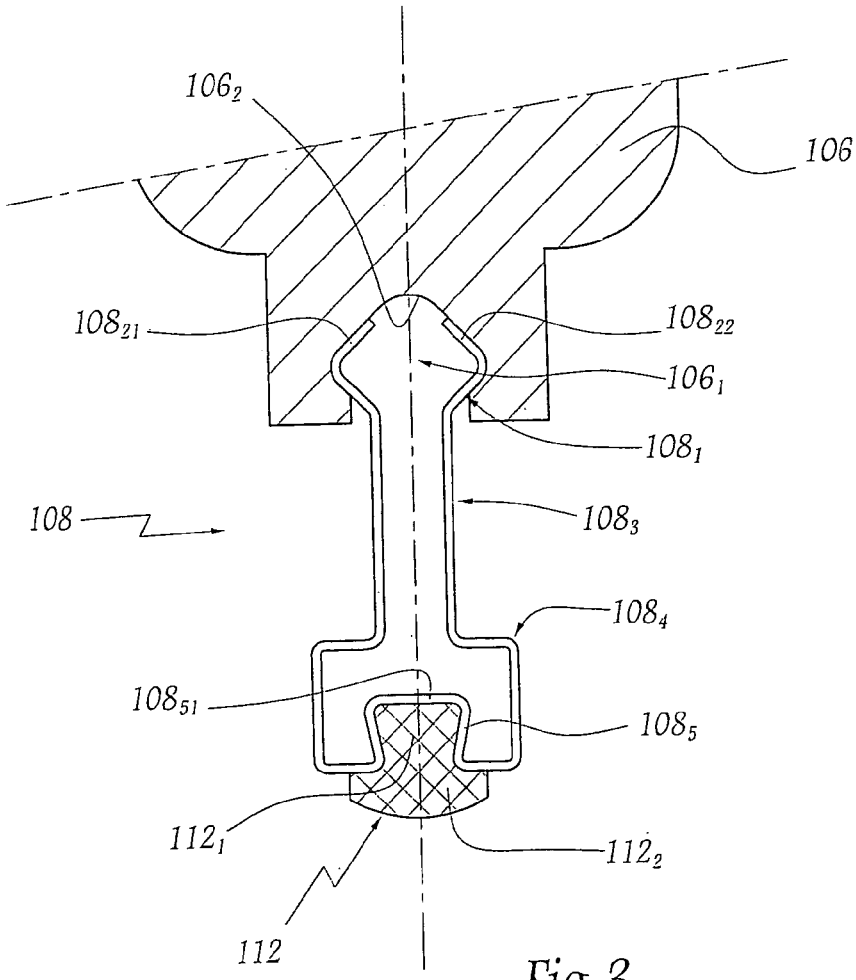
FIGS. 3 to 9 are views in transverse section, similar to FIG. 2, illustrating seven variant embodiments of the invention.

FIG. 3 illustrates a first variant embodiment of the invention. In this Figure, the mechanical elements similar to those of FIG. 2 are given the same reference numerals, increased by 100.

The crossbeam 106 has a recess $\mathbf{106}_1$, being, in cross section, in the form of a rhombus, hollowed out therein. This recess, which is open in the direction of the heddle (not shown), opens towards the outside via a neck, of reduced transverse dimension.

The bar 108 is provided with a region of fixation $\mathbf{108}_1$, which comprises two branches $\mathbf{108}_{21}$ and $\mathbf{108}_{22}$ in the form of an L, forming the free ends of the bent metal sheet constituting the bar 108.

The region of fixation 108, may be introduced in the recess $\mathbf{106}_1$, by pinching the two branches $\mathbf{108}_{21}$ and $\mathbf{108}_{22}$ so that it penetrates through the afore-mentioned neck. These two branches are then applied against the walls $\mathbf{106}_2$ of the recess $\mathbf{106}_1$, by elasticity and/or pre-stress of the metal sheet constituting the bar.

As in the example of FIG. 2, the two branches $\mathbf{108}_{21}$, $\mathbf{108}_{22}$ are formed so as to be urged to move towards each other in an intermediate region $\mathbf{108}_3$, of reduced section, which extends in a catching region $\mathbf{108}_4$. The latter has a profile substantially similar to that of the region $\mathbf{8}_4$ of FIG. 2, apart from the bend $\mathbf{108}_5$ which has a U-shaped section whose wings are inclined opposite each other. In other words, this bend $108_5$ defines a housing which has larger dimensions at the level of the web $108_{51}$ of the U than at its opening.

Finally, the bar 108 is provided with a damping element 112 substantially in the form of a mushroom. For example it comprises a stalk $112_1$ received in the interior volume of the bend $108_5$, as well as a cap $112_2$ abutting against the lower face of the bar 108. The mutual connection between this bar 108 and this damping element 112 is effected thanks to a wedging by cooperation of shapes and/or to adhesion.

Figure 4:
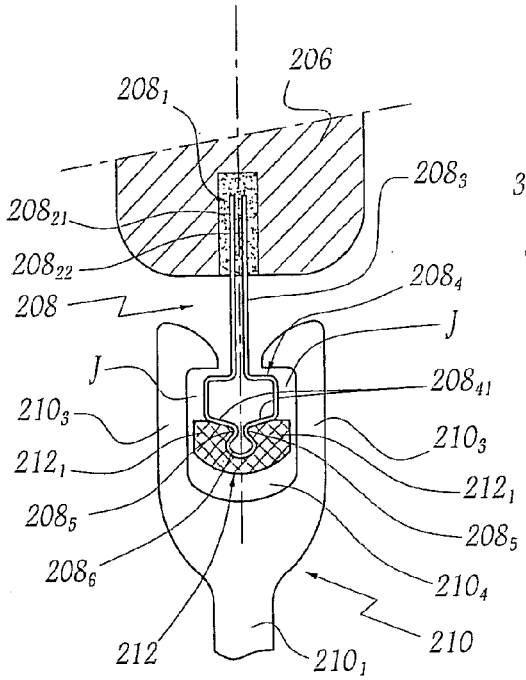

FIG. 4 illustrates a second variant embodiment of the invention. In this Figure, the mechanical elements similar to those of FIG. 2 are given the same reference numerals, increased by 200.

The catching region $208_4$ of the bar 208 has the approximate shape of a rectangle. It is provided with two lower branches $208_{41}$ which are inclined opposite the crossbeam 206.

Each branch $208_{41}$ is extended by a corresponding bend $208_5$, substantially in the form of a V or U. These two bends $208_5$ are connected by a terminal connection portion $208_6$, approximately in the form of an arc of circle.

Moreover, the damping element 212 is hollowed out, with the result that the walls of this recess are applied against the outer face of the branches $208_{41}$, of the bends $208_5$ and of the connection portion $208_6$. This element 212, which is therefore retained in particular at the two bends $208_5$, is fixed to the bar 208 by cooperation of shapes and/or adhesion.

It should be noted that the damping element 212 presents lateral dimensions greater than those of the catching region $208_4$. For example, this damping element is provided with two lateral projections $212_1$, defining two functional clearances denoted J. In service, these projections therefore extend in the vicinity of the branches $210_3$ of the heddle 210, so as to avoid any contact between these branches and the catching region $208_4$ of the bar 208.

The catching region $208_4$ extends, opposite the damping element 212, by an intermediate region $208_3$, similar to those 83 and $108_3$ described above. Contrary to the preceding examples, the region $208_1$ for fixation on the crossbeam 206 is formed by a simple extension of the intermediate region $208_3$, without modifying the transverse dimensions with respect to the latter. The two branches $208_{21}$ and $208_{22}$ are thus fixed permanently on the upper crossbeam 206, particularly by adhesion or by wedging.

Figure 5:
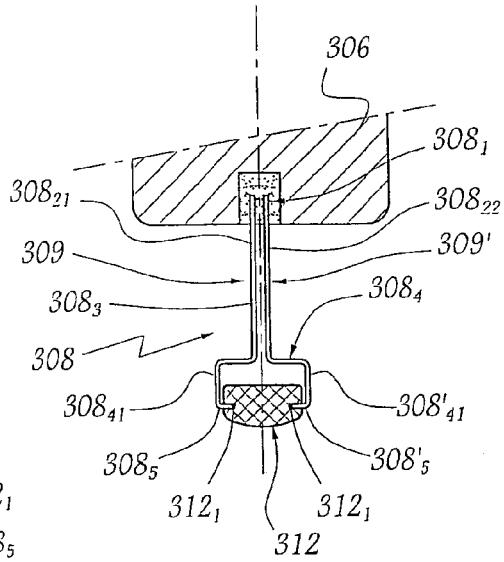

FIG. 5 illustrates a third variant embodiment of the invention. In this Figure, the mechanical elements similar to those of FIG. 2 are given the same references numerals, increased by 300.

The bar 308 of FIG. 5 differs from those of the preceding examples in that it is formed by two separate bent metal sheets 309 and 309'. In service, these latter extend, in mutually symmetrical manner with respect to the direction Z-Z' of vertical oscillation of the frames.

The catching region $308_4$ therefore differs from those of the preceding examples, in that it is open opposite the crossbeam 306. More precisely, this catching region $308_4$ is substantially in the form of a U, of which the wings $308_{41}$ and $308'_{41}$ are terminated by reentrant flanges $308_5$ and $308'_5$, of which each belongs to a corresponding bent metal sheet 309 or 309'. These re-entrant flanges thus form bends of the metal sheets constituting the bar 308, while the damping element 312, which is globally solid, has two notches $312_1$ and $312'_1$ hollowed out therein, intended for receiving these flanges $308_5$ and $308'_5$.

The catching region $308_4$ extends in an intermediate region $308_3$, which is itself terminated by a region $308_1$, ensuring fixation of the bar 308 on the crossbeam 6. Precisely, these respectively intermediate ($308_3$) and fixation ($308_1$) regions are constituted by two parallel branches $308_2$, and $308_{22}$, of which each belongs to a corresponding bent metal sheet 309 or 309'.

Figure 6:
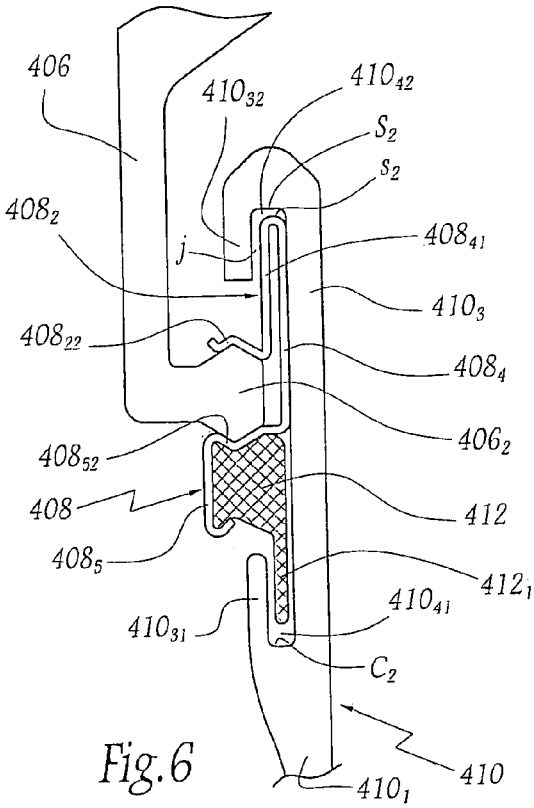

FIG. 6 illustrates a fourth variant embodiment of the invention. In this Figure, the mechanical elements similar to those of FIG. 2 are given the same reference numerals, increased by 400.

The heddle 410 of this embodiment differs from the preceding examples in that it is dissymmetrical. Each of its ends is thus substantially C-shaped, the wire-like element $410_1$ being extended by a single branch $410_3$, from which an intermediate tooth $410_{31}$ and a return $410_{32}$ respectively extend. This tooth and this return, which are directed towards each other, define with the branch $410_3$ two interstices $410_{41}$, $410_{42}$.

Furthermore, the bar 408 comprises a zone $408_5$, bent in the form of a U, in which is housed the damping element 412, which is fixed by cooperation of shapes and/or adhesion. This damping element 412 is provided with a rib $412_1$, extending towards the wire-like element $410_1$, which is received in the interstice $410_{41}$.

One, $408_{52}$, of the wings of the U-shaped portion $408_5$ is extended by an intermediate branch $408_4$, extending along the vertical axis Z–Z' up to the interstice $410_{42}$, so as to ensure catching of the heddle 410. This intermediate branch is extended by all end branch $408_2$, substantially in L-form.

More precisely, this end branch $408_2$ comprises a portion $408_{41}$, parallel to the intermediate branch $408_4$, as well as a terminal portion $408_{22}$, forming a free end of the bent metal sheet constituting the bar 408. The portion $408_{41}$ is separated from the opposite walls of the return $410_{32}$ of the heddle 410, which defines a functional lateral clearance, denoted i, making it possible to avoid substantially all contact between these two mechanical elements.

The terminal portion $408_{22}$ and the wing $408_{52}$, which are substantially parallel, are bent so as to have a local increase in their relative separation. This therefore allows the fixation of the bar 408 on a lug $406_2$ of the crossbeam 406 having, in cross section, substantially the shape of a rhombus. This mutual fixation is ensured in similar manner to what was described with reference to the first embodiment illustrated in FIG. 2.

In manner similar to the first embodiment described with reference to FIG. 2, $s_2$ denotes the surfaces of the catching bar 408, which are adapted to come into direct abutment against the opposite surfaces $S_2$ of the heddle 410. $C_2$ likewise denotes the surfaces of the heddle against which the damping element 412 is adapted to come into abutment, by its rib $412_1$. As may be observed, the damping element 412 is therefore provided opposite the surfaces $s_2$ for direct abutment of the catching bar 408.

As explained with reference to FIG. 2, when the traction surfaces $S_2$ of the heddle 410 are in direct abutment against the opposite surfaces $s_2$ of the bar 408, the lower end (not shown) of this heddle is substantially in abutment against the lower damping element, likewise not shown. In addition, when the lower end of the heddle is in direct abutment, by its lower surfaces of traction, against the opposite surfaces of the lower bar (not shown), the upper end of this heddle is substantially in abutment, by its upper surfaces of compression $C_2$, against the upper damping element 412.

Figure 7:
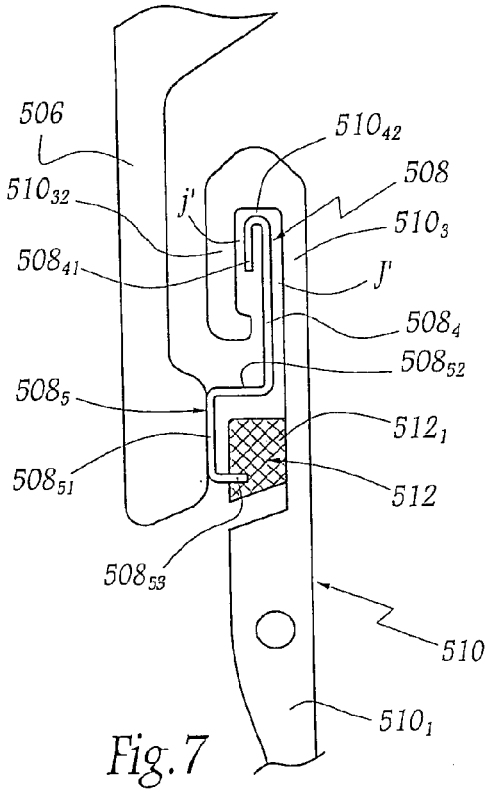

FIG. 7 illustrates a fifth variant embodiment of the invention. In this Figure, the mechanical elements similar to those of FIG. 2 are given the same reference numerals, increased by 500.

The heddle 510 of this FIG. 7 differs from that of FIG. 6 in that it has an overall section in the form of a J. For example, it is solely provided with an upper return $\mathbf{510}_{32}$, being without a lower tooth. The branch $\mathbf{510}_3$ of the heddle 510 is distant from the opposite branch $\mathbf{508}_4$ of the bar 508, thus forming a first lateral functional clearance, noted J'.

One, $\mathbf{508}_{52}$, of the wings of the U-shaped portion $\mathbf{508}_5$ is extended by the aforementioned branch $\mathbf{508}_4$, which is partially received in the interstice $\mathbf{510}_{42}$, so as to ensure the catching of the heddle 510. This branch $\mathbf{508}_4$ is terminated by a return $\mathbf{508}_{41}$, extending substantially at 180°, which is placed at a distance from the opposite upper return $\mathbf{510}_{32}$, belonging to the heddle 510, so as to form a second lateral functional clearance, denoted i'.

The other, $\mathbf{508}_{53}$, of the wings of the U-shaped portion $\mathbf{508}_5$, forms a free end of the bar 508. This wing $\mathbf{508}_{53}$ penetrates in a notch made in the damping element 512.

The latter is therefore fitted on this free end $\mathbf{508}_{53}$, such a connection being able, for example, to be completed by adhesion. It should be noted that, as illustrated in this FIG. 7, the damping element 512 does not necessarily extend against the web $\mathbf{508}_5$, and the wing $\mathbf{508}_{52}$ of the portion $\mathbf{508}_5$.

Furthermore, this damping element 512 is provided with a part $\mathbf{512}_1$, projecting laterally with respect to the branch $\mathbf{508}_4$ of the bar 508. In service, this projection 512, therefore comes into abutment against the branch $\mathbf{510}_3$ of the heddle 510, so as to avoid any contact between this branch of the heddle and the opposite branch $\mathbf{508}_4$ of the bar 508.

Consequently, the mutual lateral friction of the bar and the heddle is substantially eliminated, this contributing to reducing the wear undergone by these two pieces, accordingly.

It should be noted that each of the bars 408 or 508 of FIGS. 6 and 7 can be used equally well with heddles of different shapes, particularly C- or J-shaped. In this way, there is only need to change the damping element 412 or 512, as a function of the use considered.

Figure 8:
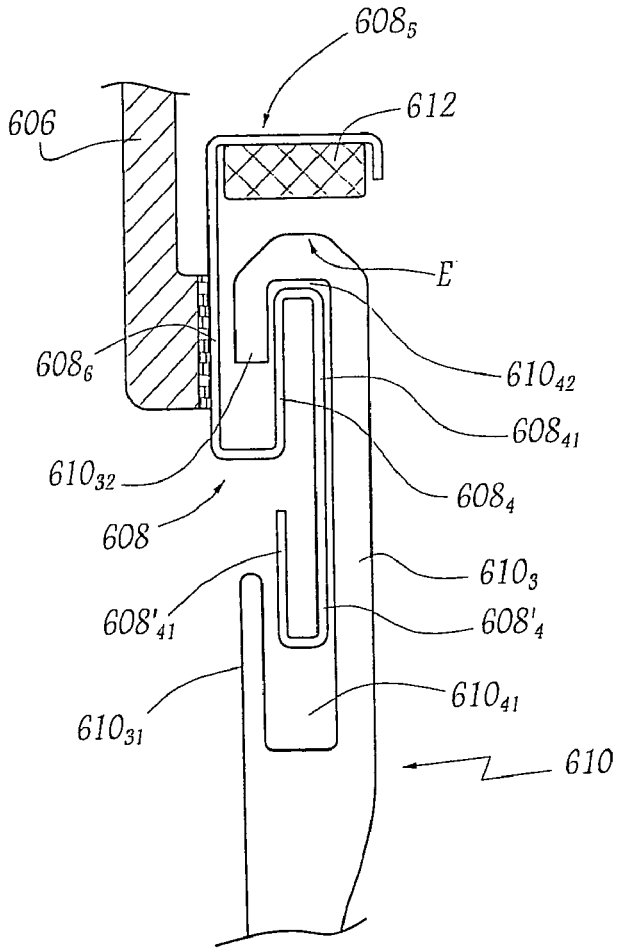

FIG. 8 illustrates a sixth variant embodiment of the invention.

The heddle 610 of this FIG. 8 is similar to that 410 of FIG. 6. This heddle 610 thus comprises a wire-like body $\mathbf{610}_1$ extended by a principal branch $\mathbf{610}_3$, from which there respectively extend an intermediate tooth $\mathbf{610}_{31}$ and a return $\mathbf{610}_{32}$ in a form of spaced flanges. This tooth and this return define, with the afore-mentioned principal branch, two interstices $\mathbf{610}_{41}$ and $\mathbf{610}_{42}$, while E denotes the free end of this heddle 610.

The bar 608 comprises a branch for fixation $\mathbf{608}_6$, which is permanently fixed on the crossbeam 606, particularly by adhesion. This branch $\mathbf{608}_6$ is extended upwardly, namely opposite the wire-like body $\mathbf{610}_1$, by a bend $\mathbf{608}_5$, substantially in the form of a U. Similarly to what has been described previously, this bend $\mathbf{608}_5$ ensures the retention of a damping element 612, by wedging and/or adhesion.

The fixation branch $\mathbf{608}_6$ is, in addition, extended, opposite the bend $\mathbf{608}_5$, by a first catching branch $\mathbf{608}_4$, which is received in the interstice $\mathbf{610}_{42}$. This branch $\mathbf{608}_4$ is extended by a first return $\mathbf{608}_{41}$, parallel to the principal branch $\mathbf{610}_3$. This first return is itself extended by a second catching branch $\mathbf{608'}_4$, received in the interstice $\mathbf{604}_1$, which is terminated by a second return $\mathbf{608'}_{41}$, directed towards the free end E of the bar.

It should be noted that, contrary to the previous form of embodiment, the damping member 612 is not placed opposite the surfaces for direct abutment of the catching member against the heddle. In effect, in this FIG. 8, this catching member 612 is placed opposite the free end E of the heddle 610, with respect to the wire-like body $\mathbf{610}_1$ thereof.

Figure 9:
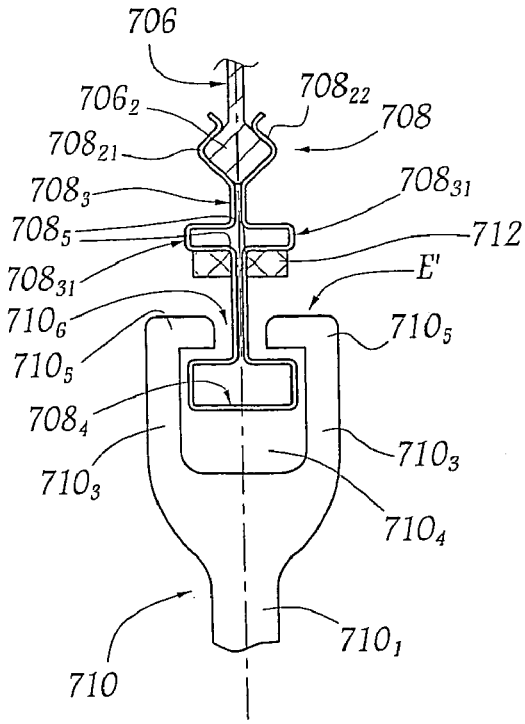

FIG. 9 illustrates a seventh variant embodiment of the invention. The heddle 710 of this FIG. 9, which is similar to that, 10, of FIG. 2, comprises a wire-like body $\mathbf{710}_1$, which extends in two principal branches $\mathbf{710}_3$, defining a housing $\mathbf{710}_4$ for receiving the bar 708. The opening of this housing is bordered by two teeth $\mathbf{710}_5$ of the heddle, which define a neck $\mathbf{710}_6$ of reduced transverse dimension. Finally E' denotes the Free end of this heddle, opposite the wire-like body $\mathbf{710}_1$.

The bar 708, which is substantially similar to that, 8, of FIG. 2, comprises a region for fixation formed by two branches $\mathbf{708}_{21}$ and $\mathbf{708}_{22}$, adapted to cover a lug $\mathbf{706}_2$ of the bar 706. Opposite this region of fixation, the bar 708 is equipped with a catching region $\mathbf{708}_4$, which has an approximately rectangular cross section.

In service, this catching region $\mathbf{708}_4$ is received in the housing $\mathbf{710}_4$ of the heddle 710. However, it will be noted that, contrary to the form of embodiment of FIG. 2, this catching region is free of a bend, intended for retaining a damping member.

The region for fixation and the catching region are mutually connected by an intermediate region $\mathbf{708}_3$ of which a portion is received in the neck $\mathbf{710}_1$. It will be noted that, contrary to the embodiment of FIG. 2, this intermediate region does not have a constant cross section.

In effect, it is provided with two lateral projections $\mathbf{708}_{31}$, substantially U-shaped, which extend symmetrically with respect to the principal vertical axis of the heddle. These two projections $\mathbf{708}_3$, define, opposite the free end E', two V-shaped bends $\mathbf{708}_5$ intended for the retention by cooperation of shapes and/or by adhesion, of two damping members 712.

It will be noted that, as in the embodiment of FIG. 8, each damping member 712 is placed opposite the free end E' of the heddle 710, with respect to the wire-like body 710, thereof. In service, this free end E' is thus adapted to abut against each of these damping members.

In a variant embodiment, a single projection $\mathbf{708}_{31}$ may be provided, associated with a single damper 712. By way of additional variant, at least one damper may be fixed directly, for example by adhesion, on a vertical part of the intermediate region $\mathbf{708}_3$, which is in that case free of lateral projection.

The invention makes it possible to attain the objects set forth hereinabove.

In effect, the use of a bent metal sheet with a view to making the catching bar, renders manufacture of the latter satisfactorily simple, at a relatively low cost Furthermore, this measure makes it possible to reduce the overall mass of the frame with respect to the prior art, while ensuring an easier integration of the damping element, as well as a convenient fixation of the catching member on the crossbeam of the frame.

In addition, the reduced section of the metal sheet constituting the catching bar renders the latter less sensitive to the problems of differential expansion, which the catching members proposed in the prior art do not.

Finally, it should be noted that, thanks to the invention, the operations for installing and replacing the damping element are particularly simple and rapid to carry out.

What is claimed is:

1. A heddle frame for a weaving loom, said frame comprising two spaced uprights and two spaced crossbeams, a catching member mounted to each crossbeam and adapted to engage a corresponding end of at least one heddle of said heddle frame, at least one of said catching members being formed of at least one piece of bent sheet metal, damping means carried by said at least one catching member, said damping means and said at least one catching member being cooperatively configured such that said damping means is retained on said at least one catching member due to their complimentary shapes, said damping means being positioned on said at least one catching member so as to be engageable with a compression surface of said corresponding end of said at least one heddle to thereby dampen vibrations along said at least one heddle and said two spaced crossbeams as said at least one heddle is moved in a first direction between said two spaced crossbeams and said at least one catching member including at least one metallic abutment traction surface, spaced from said damping means, that is directly engageable with an opposing abutment traction surface of said corresponding end of said at least one heddle as said at least one heddle is moved in a second opposite direction between said two spaced crossbeams and such that said damping means is spaced from said compression surface of said corresponding end of said at least one heddle as said at least one heddle is moved in said second opposite direction.

2. The heddle frame of claim 1, wherein said at least one piece of bent sheet metal has a substantially constant thickness.

3. The heddle frame of claim 2, wherein the thickness of said at least one piece of bent sheet metal is less than 1.5 mm.

4. The heddle frame of claim 1, wherein said damping means has a profile that is constant along a length of said at least one catching member.

5. The heddle frame of claim 4, wherein said damping means is fixed on said at least one catching member by adhesion.

6. The heddle frame of claim 1, wherein at least one bend in said at least one piece of bent sheet metal forms a zone for receiving and retaining said damping means.

7. The heddle frame of claim 6, wherein said bend for receiving and retaining is substantially in a form of a U.

8. The heddle frame of claim 6, wherein said bend for receiving and retaining is substantially in a form of a V.

9. The heddle frame of claim 1, wherein said damping means is connected to said at least one catching member at a free end of said at least one piece of bent sheet metal.

10. The heddle frame of claim 1, wherein said at least one heddle includes at least one end having two principal branches defining a housing which opens out in a direction of a corresponding crossbeam by way of a neck, said at least one catching member including a catching region extending into said housing and an intermediate region extending through said neck.

11. The heddle frame of claim 1, wherein said at least one heddle includes at least one end having a principal branch and a pair of spaced flanges defining at least one receiving interstice, and said at least one catching member has at least one catching branch housed in said at least one receiving interstice.

12. The heddle frame of claim 11, wherein said catching branch is formed to include a pair of branch segments that extend within said at least one receiving interstice.

13. The heddle frame of claim 1, wherein said at least one catching member includes a catching region including two spaced abutment traction surfaces that are oppositely oriented with respect to and that are directly engageable by two abutment traction surfaces of at least one heddle.

14. The heddle frame of claim 10, wherein said damping means are provided with at least one lateral projection extending toward each principal branch of said at least one heddle, so as to laterally separate said principal branches with respect to said catching region of said at least one catching member and thus prevent lateral friction between said principal branches and said catching region.

15. The heddle frame of claim 10, wherein said damping means are placed opposite a free end of said corresponding end of said at least one heddle with respect to a wire-like body of said at least one heddle.

16. The heddle frame of claim 1, wherein said at least one piece of bent sheet metal is elastic.

17. The heddle frame of claim 1, wherein said at least one catching member is permanently secured to said corresponding crossbeam.

18. The heddle frame of claim 1, wherein each of said catching members is formed of at least one sheet of bent sheet metal, a damping means carried by each of said catching members, said at least one heddle having opposite first and second ends each having at least one abutment traction surface that is alternately engageable with said at least one metallic abutment traction surface of each of said catching members, and each of said damping means being spaced from said at least one metallic abutment traction surface of an associated catching member and positioned so as to be alternately engageable with a compression surface adjacent each of said first and second ends of said at least one heddle.

19. A weaving loom including at least one heddle frame, said at least one heddle frame including two spaced uprights and two spaced crossbeams, a catching member mounted to each crossbeam adapted to be engageable with a corresponding end of at least one heddle of said frame, at least one catching member being formed by at least one piece of bent sheet metal, damping means carried by said at least one of said catching members, said damping means and said at least one catching member being cooperatively configured such that said damping means is retained on said at least one catching member due to their complimentary shapes, said damping means being positioned on said at least one catching member so as to be engageable with a compression surface of said corresponding end of said at least one heddle to thereby dampen vibrations along said at least one heddle and said two spaced crossbeams as said at least one heddle is moved in a first direction between said two spaced crossbeams, and said at least one catching member including at least one metallic abutment traction surface, spaced from said damping means, that is directly engageable with an opposing abutment traction surface of said corresponding end of said at least one heddle as said at least one heddle is moved in a second opposite direction between said two spaced crossbeams and such that said damping means is spaced from said compression surface of said corresponding end of said at least one heddle as said at least one heddle is moved in said second opposite direction.

20. The heddle frame of claim 1, wherein each of said corresponding ends of said at least one heddle includes a compression surface and an abutment traction surface, each of said catching members is formed of at least one sheet of bent metal sheet, each of said catching members includes at least one metallic abutment traction surface and damping means, said at least one metallic abutment traction surface and said damping means of each of said catching members being positioned relative to one another such that when said abutment traction surface of a first corresponding end of said at least one heddle engages said at least one metallic abutment traction surface of an adjacent first catching member, said compression surface of a second corresponding end of said at least one heddle engages said damping means of an adjacent second catching member, and wherein when said abutment traction surface of the second corresponding end of said at least one heddle engages said at least one metallic abutment traction surface of said adjacent second catching member, said compression surface of the first corresponding end of said at least one heddle engages said damping means of said adjacent first catching member to thereby dampen vibrations along said at least one heddle and said crossbeams.

21. A weaving loom comprising at least one heddle frame, said at least one heddle frame including two spaced uprights and two spaced crossbeams, at least one heddle movable between said two spaced crossbeams and having opposite ends, a catching member mounted to each crossbeam so as to be in opposing relationship with one another, each catching member being formed by at least one piece of bent sheet metal and each catching member including at least one metallic abutment traction surface that is drivingly engageable with a corresponding one of said opposite ends of said at least one heddle, each of said opposite ends of said at least one heddle including an abutment traction surface that is drivingly engageable by said at least one metallic abutment traction surface of one of said catching members and an oppositely oriented compression surface, damping means carried by each catching member in spaced relationship to said at least one metallic abutment traction surfaces thereof, and said at least one metallic abutment traction surface and said damping means of each of said catching members being positioned relative to one another such that when said abutment traction surface of a first end of said at least one heddle engages said at least one metallic abutment traction surface of an adjacent first catching member, said compression surface of a second end of said at least one heddle engages said damping means of an adjacent second catching member, and wherein when the second end of said at least one heddle engages said at least one metallic abutment traction surface of said adjacent second catching member, said compression surface of the first end of said at least one heddle engages said damping means of said adjacent first catching member to thereby dampen vibrations along said at least one heddle and said crossbeams.

22. A heddle frame for a weaving loom, said frame comprising two spaced uprights and two spaced crossbeams, a catching member mounted to each crossbeam adapted to engage a corresponding end of at least one heddle of said frame, damping means secured to at least one of said catching members, said at least one catching member being formed by at least one piece of bent sheet metal, and means for removably mounting said at least one catching member on a corresponding crossbeam.

23. The heddle frame of claim 22, wherein said means for removably mounting includes said at least one catching member and said corresponding crossbeam having components that are cooperatively configured to interjoin with one another due to their complimentary shapes.

24. The heddle frame of claim 23, wherein said means for removably mounting includes two branches of said at least one piece of bent sheet metal that engage opposite walls of said corresponding crossbeam.

25. The heddle frame of claim 24, wherein said two branches cover a lug of said corresponding crossbeam.

26. The heddle frame of claim 24, wherein said two branches are resiliently urged against walls of a recesses made in said corresponding crossbeam.

* * * * *